US005293588A

United States Patent [19]

Satoh et al.

[11] Patent Number: 5,293,588

[45] Date of Patent: Mar. 8, 1994

[54] SPEECH DETECTION APPARATUS NOT AFFECTED BY INPUT ENERGY OR BACKGROUND NOISE LEVELS

[75] Inventors: Hideki Satoh; Tsuneo Nitta, both of Kanagawa, Japan

[73] Assignee: Kabushiki Kaisha Toshiba, Kawasaki, Japan

[21] Appl. No.: 682,079

[22] Filed: Apr. 9, 1991

[30] Foreign Application Priority Data

Apr. 9, 1990 [JP] Japan ..... 2-92083
Jun. 27, 1990 [JP] Japan ..... 2-172028

[51] Int. Cl.[5] ..... G10L 9/00
[52] U.S. Cl. ..... 395/2.42
[58] Field of Search ..... 381/29-47; 395/2.42

[56] References Cited

U.S. PATENT DOCUMENTS

| | | | |
|---|---|---|---|
| 3,832,491 | 8/1974 | Sciulli et al. | 381/46 |
| 4,410,763 | 10/1983 | Strawczynski et al. | 364/513.5 |
| 4,627,091 | 12/1986 | Fedele | 381/46 |
| 4,630,304 | 12/1986 | Borth et al. | 381/47 |
| 4,677,673 | 6/1987 | Ukita et al. | 381/43 |
| 4,696,041 | 9/1987 | Sakata | 381/46 |
| 4,713,778 | 12/1987 | Baker | 381/43 |
| 4,829,578 | 5/1989 | Roberts | 395/2 |

FOREIGN PATENT DOCUMENTS

| | | |
|---|---|---|
| 335521 | 10/1989 | European Pat. Off. . |
| 58-211793 | 12/1983 | Japan . |

OTHER PUBLICATIONS

IBM Technical Disclosure Bulletin, "Digital Signal Processing Algorithm for Microphone Input Energy Detection Having Adaptive Sensitivity", vol. 29, No. 12, May 1987, pp. 5606-5609.

P. DeSouza, *IEEE Transactions on Acoustics, Speech, and Signal Processing,* "A Statistical Approach to the Design of an Adaptive Self-Normalizing Silence Detector", vol. ASSP-31, No. 3, Jun. 1983, pp. 678-684.

*Primary Examiner*—Michael R. Fleming
*Assistant Examiner*—Michelle Doerrler
*Attorney, Agent, or Firm*—Foley & Lardner

[57] ABSTRACT

A speech detection apparatus capable of reliably detecting speech segments in audio signals regardless of the levels of input audio signals and background noises. In the apparatus, a parameter of input audio signals is calculated frame by frame, and then compared with a threshold in order to judge each input frame as one of a speech segment and a noise segment, while the parameters of the input frames judged as the noise segments are stored in the buffer and the threshold is updated according to the parameters stored in the buffer. The apparatus may utilize a transformed parameter obtained from the parameter, in which the difference between speech and noise is emphasized, and noise standard patterns are constructed from the parameters of the input frames pre-estimated as noise segments.

16 Claims, 12 Drawing Sheets

SPEECH DETECTION APPARATUS NOT AFFECTED BY INPUT ENERGY OR BACKGROUND NOISE LEVELS

BACKGROUND OF THE INVENTION

1. Field of the Invention

The present invention relates to a speech detection apparatus for detecting speech segments in audio signals appearing in such fields as the ATM (asynchronous transfer mode) communication, DSI (digital speech interpolation), packet communication and speech recognition.

2. Description of the Background Art

An example of a conventional speech detection apparatus for detecting speech segments in audio signals is shown in FIG. 1.

This speech detection apparatus of FIG. 1 comprises: an input terminal 100 for inputting audio signals; a parameter calculation unit 101 for acoustically analyzing the input audio signals frame by frame to extract parameters, such as energy, zero-crossing rates, auto-correlation coefficients and spectra; a standard speech pattern memory 102 for storing standard speech patterns prepared in advance; a standard noise pattern memory 103 for storing standard noise patterns prepared in advance; a matching unit 104 for judging whether the input frame is speech or noise by comparing parameters with each of the standard patterns; and an output terminal 105 for outputting a signal which indicates the input frame as speech or noise according to a judgment by matching unit 104.

In the speech detection apparatus of FIG. 1, audio signals from the input terminal 100 are acoustically analyzed by the parameter calculation unit 101, and then parameters such as energy, zero-crossing rates, auto-correlation coefficients and spectra are extracted frame by frame. Using these parameters, the matching unit 104 decides if the input frame is speech or noise. The decision algorithm, such as the Bayer Linear Classifier, can be used in making this decision. The output terminal 105 then outputs the decision made by the matching unit 104. Another example of a conventional speech detection apparatus for detecting speech segments in audio signals is shown in FIG. 2.

This speech detection apparatus of FIG. 2 uses only energy as the parameter, and comprises: an input terminal 100 for inputting audio signals; an energy calculation unit 106 for calculating the energy P(n) of each input frame; a threshold comparison unit 108 for judging whether the input frame is speech or noise by comparing the calculated energy P(n) of the input frame with a threshold T(n); a threshold updating unit 107 for updating the threshold T(n) to be used by the threshold comparison unit 108; and an output terminal 105 for outputting a signal which indicates that the input frame is speech or noise, according to the judgment made by the threshold comparison unit 108.

In the speech detection apparatus of FIG. 2, for each input frame from the input terminal 100, the energy P(n) is calculated by the energy calculation unit 106.

Then, the threshold updating unit 107 updates the threshold T(n) to be used by the threshold comparison unit 108, as follows. When the calculated energy P(n) and the current threshold T(n) satisfy the following relation (1):

$$P(n) < T(n) - P(n) \times (\alpha - 1) \quad (1)$$

where $\alpha$ is a constant and n is a sequential frame number, then threshold T(n) is updated to a new threshold T(n+1), according to the following expression (2):

$$T(n+1) = P(n) \times \alpha \quad (2)$$

On the other hand, when the calculated energy P(n) and the current threshold T(n) satisfy the following relation (3):

$$P(n) \geqq T(n) - P(n) \times (\alpha - 1) \quad (3)$$

then the threshold T(n) is updated to a new threshold T(n+1) according to the following expression (4):

$$T(n+1) = T(n) \times \gamma \quad (4)$$

where $\gamma$ is a constant.

Alternatively, the threshold updating unit 108 may update the threshold T(n) to be used by the threshold comparison unit 108 as follows. That is, when the calculated energy P(n) and the current threshold T(n) satisfy the following relation (5):

$$P(n) < T(n) - \alpha \quad (5)$$

where $\alpha$ is a constant, then the threshold T(n) is updated to a new threshold T(n+1) according to the following expression (6):

$$T(n+1) = P(n) + \alpha \quad (6)$$

and when the calculated energy P(n) and the current threshold T(n) satisfy the following relation (7):

$$P(n) \geqq T(n) - \alpha \quad (7)$$

then the threshold T(n) is updated to a new threshold T(n+1) according to the following expression (8):

$$T(n+1) = T(n) + \gamma \quad (8)$$

where $\gamma$ is a small constant.

Then, at the threshold comparison unit 108, the input frame is recognized as a speech segment if the energy P(n) is greater than the current threshold T(n). Otherwise, the input frame is recognized as a noise segment. The result of this recognition obtained by the threshold comparison unit 108 is then outputted from the output terminal 105. Now, such a conventional speech detection apparatus has the following problems. Namely, under a heavy background noise or a low speech energy environment, the parameters of speech segments are affected by the background noise. In particular, some consonants are severely affected because their energies are lowerer than the energy of the background noise. Thus, in such a circumstance, it is difficult to judge whether the input frame is speech or noise, and discrimination errors frequently occur.

SUMMARY OF THE INVENTION

It is therefore an object of the present invention to provide a speech detection apparatus capable of reliably detecting speech segments in audio signals, regardless of the level of the input audio signals or the background noise.

According to one aspect of the present invention, there is provided a speech detection apparatus, comprising: means for calculating a parameter of each input frame; means for comparing the parameter calculated by the calculating means with a threshold in order to judge each input frame as a speech segment or a noise segment; buffer means for storing the parameters of the input frames which are judged as the noise segments by the comparing means; and means for updating the threshold according to the parameters stored in the buffer means.

According to another aspect of the present invention there is provided a speech detection apparatus, comprising: means for calculating a parameter for each input frame; means for judging each input frame as a speech segment or a noise segment; buffer means for storing the parameters of the input frames which are judged noise segments by the judging means; and means for transforming the parameter calculated by the calculating means into a transformed parameter in which a difference between speech and noise is emphasized by using the parameters stored in the buffer means, and supplying the transformed parameter to the judging means, such that the judging means judges by using the transformed parameter.

According to another aspect of the present invention there is provided a speech detection apparatus, comprising: means for calculating a parameter of each input frame; means for comparing the parameter calculated by the calculating means with a threshold in order to pre-estimate noise segments in input audio signals; buffer means for storing the parameters of the input frames which are pre-estimated as the noise segments by the comparing means; means for updating the threshold according to the parameters stored in the buffer means; means for judging each input frame as a speech segment or a noise segment; and means for transforming the parameter calculated by the calculating means into a transformed parameter in which a difference between speech and noise is emphasized by using the parameters stored in the buffer means, and supplying the transformed parameter to the judging means such that the judging means judges by using the transformed parameter.

According to another aspect of the present invention there is provided a speech detection apparatus, comprising: means for calculating a parameter for each input frame; means for pre-estimating the noise segments in input audio signals; means for constructing noise standard patterns from parameters of the noise segments pre-estimated by the pre-estimating means; and means for judging each input frame as a speech segment or a noise segment, according to the noise standard patterns constructed by the constructing means and predetermined speech standard patterns.

According to another aspect of the present invention there is provided a speech detection apparatus, comprising: means for calculating a parameter of each input frame; means for transforming the parameter calculated by the calculating means into a transformed parameter in which the difference between speech and noise is emphasized; means for constructing noise standard patterns from the transformed parameters; and means for judging each input frame as a speech segment or a noise segment, according to the transformed parameter obtained by the transforming means and the noise standard pattern constructed by the constructing means.

Other features and advantages of the present invention will become apparent from the following description taken in conjunction with the accompanying drawings.

DETAILED DESCRIPTION OF THE PREFERRED EMBODIMENTS

Figure 1:
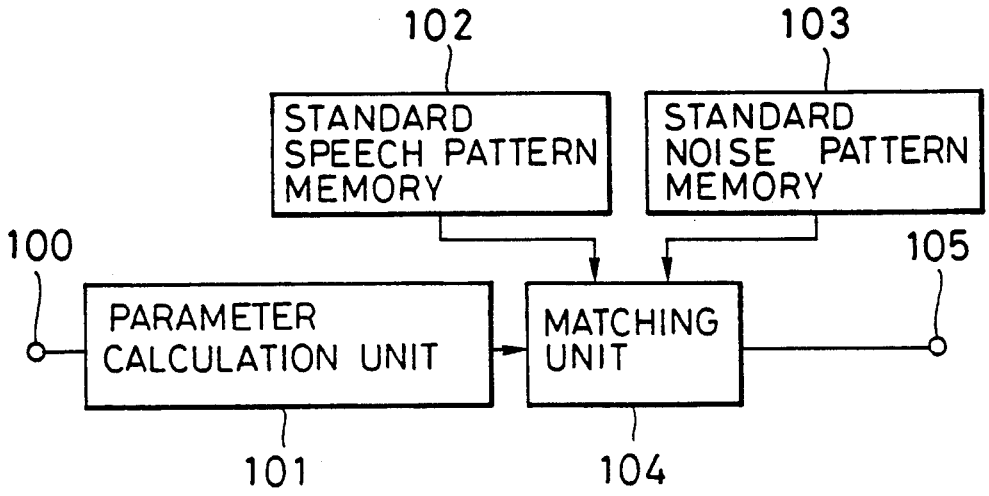
FIG. 1 PRIOR ART
FIG. 1 is a schematic block diagram of a conventional speech detection apparatus.
Figure 2:
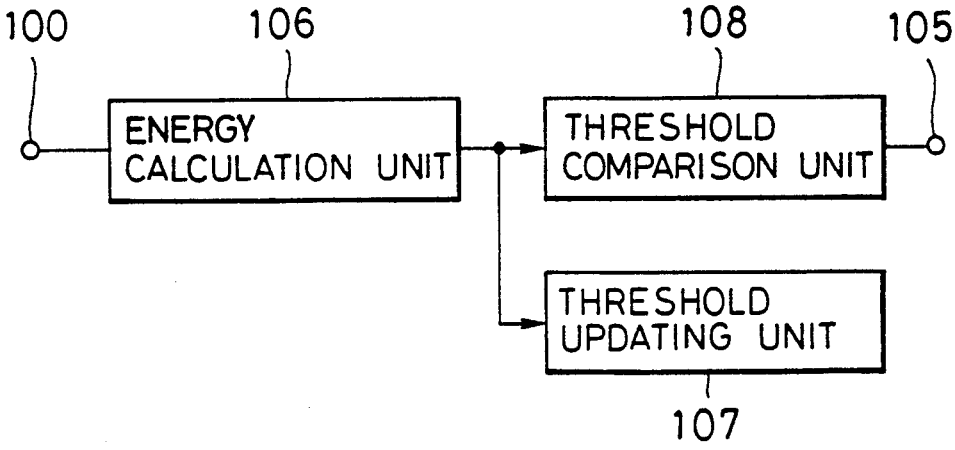
FIG. 2 PRIOR ART
FIG. 2 is a schematic block diagram of another conventional speech detection apparatus.
Figure 3:
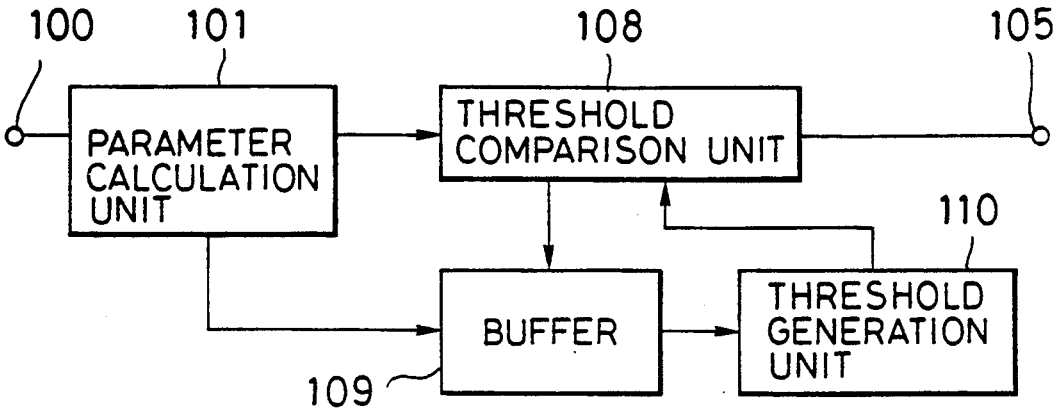
FIG. 3 is a schematic block diagram of the first embodiment of a speech detection apparatus according to the present invention.

FIG. 3, is the first embodiment of a speech detection apparatus according to the present invention. The speech detection apparatus of FIG. 3 comprises: an input terminal 100 for inputting audio signals; a parameter calculation unit 101 for acoustically analyzing each input frame to extract the parameters of the input frame; a threshold comparison unit 108 for judging whether the input frame is speech or noise by comparing the calculated parameter of each input frame with a threshold; a buffer 109 for storing the calculated parameters of those input frames which are discriminated as noise segments by the threshold comparison unit 108; a threshold generation unit 110 for generating the threshold to be used by the threshold comparison unit 108 according to the parameters stored in the buffer 109; and an output terminal 105 for outputting a signal which indicates the input frame as speech or noise, according to the judgment threshold comparison unit 108.

In this speech detection apparatus, the audio signals from the input terminal 100 are acoustically analyzed by the parameter calculation unit 101, and then the parameter for each input frame is extracted frame by frame.

For example, discrete-time signals are derived by periodic sampling from continuous-time input signals by periodic sampling, where 160 samples constitute one frame. Here, there is no need for the frame length and sampling frequency to be fixed.

Then, the parameter calculation unit 101 calculates energy, zero-crossing rates, auto-correlation coefficients, linear predictive coefficients, the PARCOR coefficients, LPC cepstrum, mel-cepstrum, etc. Some of these are used as components of a parameter vector X(n) of each n-th input frame.

The parameter X(n) so obtained can be represented as a p-dimensional vector given by the following expression (9).

$$X(n)=(x_1(n), x_2(n), \ldots, x_p(n)) \tag{9}$$

Figure 4:
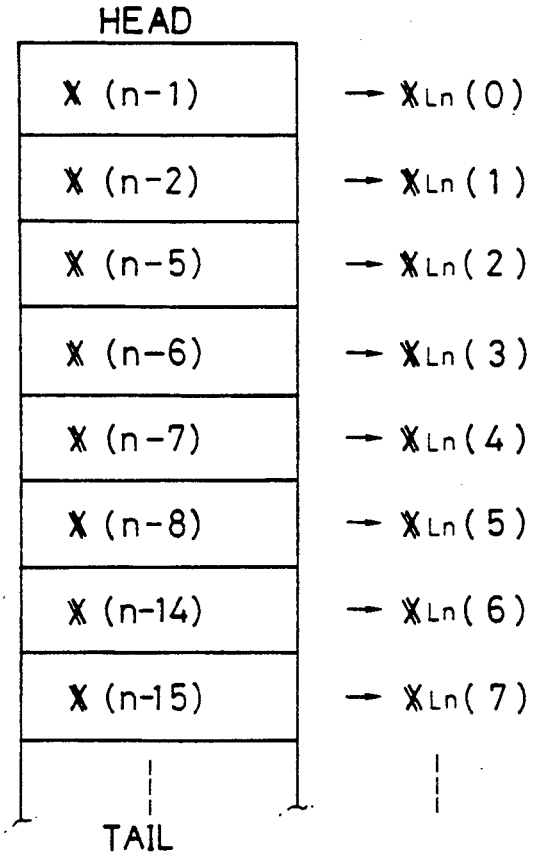
FIG. 4 is a diagrammatic illustration of a buffer in the speech detection apparatus of FIG. 3 for showing its contents.

The buffer 109 stores the calculated parameters of those input frames, which are discriminated as the noise segments by the threshold comparison unit 108, in time sequential order as shown in FIG. 4, from a head of the buffer 109 toward a tail of the buffer 109, such that the newest parameter is at the head of the buffer 109 while the oldest parameter is at the tail of the buffer 109. Here, apparently the parameters stored in the buffer 109 are only some of the parameters calculated by the parameter calculation unit 101 and therefore may not necessarily be continuous in time sequence.

Figure 5:
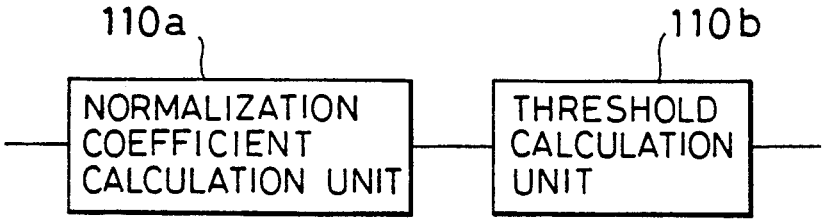
FIG. 5 is a block diagram of a threshold generation unit of the speech detection apparatus of FIG. 3.

The threshold generation unit 110 has a detailed configuration shown in FIG. 5 which comprises a normalization coefficient calculation unit 110*a* for calculating a mean and a standard deviation of the parameters of a part of the input frames stored in the buffer 109; and a threshold calculation unit 110*b* for calculating the threshold from the calculated mean and standard deviations.

More specifically, in the normalization coefficient calculation unit 110*a*, a set Ω(n) constitutes N parameters from the S-th frame of the buffer 109 toward the tail of the buffer 109. Here, the set Ω(n) can be expressed as the following expression (10).

$$\Omega(n):\{X_{Ln}(S), X_{Ln}(S+1), \ldots, X_{Ln}(S+N-1)\} \tag{10}$$

where $X_{Ln}(i)$ is another expression of the parameters in the buffer 109 as shown in FIG. 4.

Then, the normalization coefficient calculation unit 110*a* calculates the mean $m_i$ and the standard deviation $\sigma_i$ of each element of the parameters in the set Ω(n) according to the following equations (11) and (12).

$$m_i(n) = (1/N) \sum_{j=S}^{N+S-1} X_{Lni}(j) \tag{11}$$

$$\sigma_i^2(n) = (1/N) \sum_{j=S}^{N+S-1} (X_{Lni}(j) - m_i(n))^2 \tag{12}$$

where $$X_{Ln}(j)=\{x_{Ln1}(j), x_{Ln2}(j), \ldots, x_{Lnp}(j)\}$$

The mean $m_i$ and the standard deviation $\sigma_i$ for each element of the parameters in the set Ω(n) may be given by equations (13) and (14).

$$m_i(n) = \sum_{j}^{N} x_i(j)/N \tag{13}$$

$$\sigma_i^2(n) = \sum_{j}^{N} (x_i(j) - m_i(n))^2/N \tag{14}$$

where j satisfies the following condition (15):

$$X(j)\epsilon\Omega'(n) \text{ and } j<n-S \tag{15}$$

and takes a larger value in the buffer 109, and where Ω'(n) is a set of the parameters in the buffer 109.

The threshold calculation unit 110*b* then calculates the threshold T(n) to be used by the threshold comparison unit 108 according to equation (16).

$$T(n)=\alpha\times m_i+\beta\times\sigma_i \tag{16}$$

where α and β are arbitrary constants, and $1 \leqq i \leqq P$.

Here, until the parameters for N+S frames are compiled in the buffer 109, the threshold T(n) is taken to be a predetermined initial threshold $T_0$.

The threshold comparison unit 108 then compares the parameter of each input frame calculated by the parameter calculation unit 101 with the threshold T(n) calculated by the threshold calculation unit 110*b*, and then judges whether the input frame is speech or noise.

Now, the parameter can be one-dimensional and positive in a case of using the energy or a zero-crossing rate as the parameter. When the parameter X(n) is the energy of the input frame, each input frame is judged as a speech segment under the following condition (17):

$$X(n) \geqq T(n) \tag{17}$$

On the other hand, each input frame is judged as a noise segment under the following condition (18):

$$X(n) \leqq T(n) \tag{18}$$

Here, the conditions (17) and (18) may be interchanged when using any other type of the parameter.

In a case where the dimension p of the parameter is greater than 1, X(n) can be set to $X(n)=|X(n)|$, or an appropriate element $x_i(n)$ of X(n) can be used for X(n).

A signal which indicates the input frame as speech or noise is then outputted from the output terminal 105 according to the judgment made by the threshold comparison unit 108.

Figure 6:
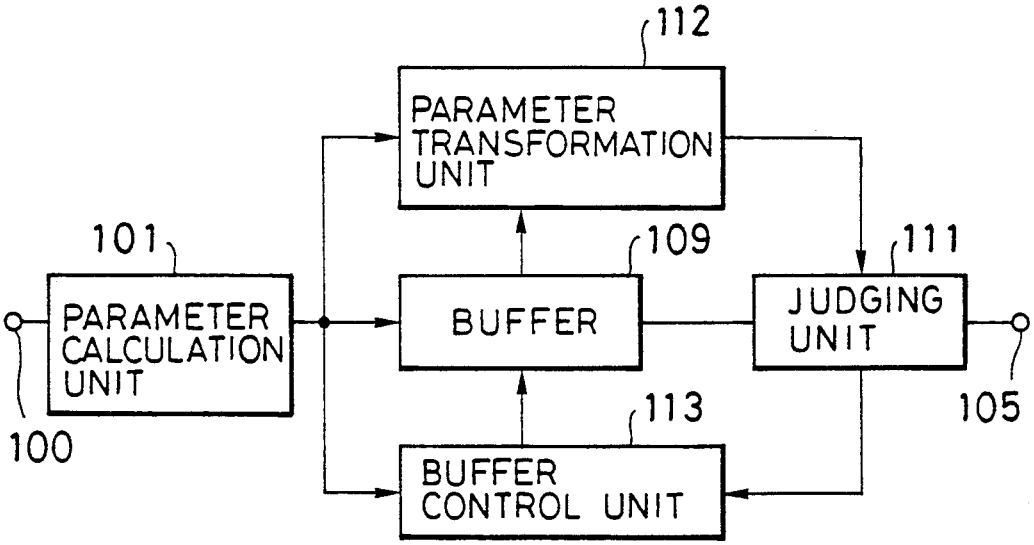
FIG. 6 is a schematic block diagram of the second embodiment of a speech detection apparatus according to the present invention.

FIG. 6 is the second embodiment of a speech detection apparatus according to the present invention.

The speech detection apparatus of FIG. 6 comprises: an input terminal 100 for inputting audio signals; a parameter calculation unit 101 for acoustically analyzing each input frame to extract a parameter; a parameter transformation unit 112 for transforming the parameter extracted by the parameter calculation unit 101 to obtain a transformed parameter for each input frame; a judging unit 111 for judging whether each input frame is a speech segment or a noise segment according to the transformed parameter obtained by the parameter transformation unit 112; a buffer 109 for storing the calculated parameters of those input frames which are judged as the noise segments by the judging unit 111; a buffer control unit 113 for inputting the calculated parameters of those input frames judged as noise segments by the judging unit 111 into the buffer 109; and an output terminal 105 for outputting a signal which indicates the input frame as speech or noise according to the judgement made by the judging unit 111.

In this speech detection apparatus, audio signals from the input terminal 100 are acoustically analyzed by the parameter calculation unit 101, and then the parameter X(n) for each input frame is extracted frame by frame, as in the first embodiment.

The parameter transformation unit 112 then transforms the extracted parameter X(n) into the transformed parameter Y(n) in which the difference between speech and noise is emphasized. The transformed parameter Y(n), corresponding to the parameter X(n) in a form of a p-dimensional vector, is an r-dimensional ($r \leqq p$) vector represented by the following expression (19).

$$Y(n)=(y_1(n), y_2(n), \ldots, y_r(n)) \tag{19}$$

Figure 7:
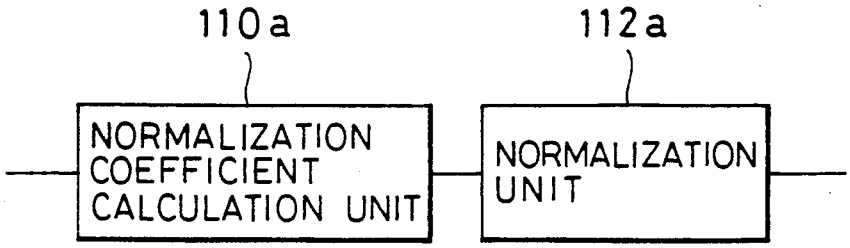
FIG. 7 is a block diagram of a parameter transformation unit of the speech detection apparatus of FIG. 6.

The parameter transformation unit 112 has a detailed configuration shown in FIG. 7 which comprises a normalization coefficient calculation unit 110*a* for calculating a mean and a standard deviation of the parameters in the buffer 109; and a normalization unit 112*a* for calculating the transformed parameter using the calculated mean and standard deviation.

More specifically, the normalization coefficient calculation unit 110*a* calculates the mean $m_i$ and the standard deviation $\sigma_i$ for each element in the parameters of a set $\Omega(n)$, where a set $\Omega(n)$ constitutes N parameters from the S-th frame of the buffer 109 toward the tail of the buffer 109, as in the first embodiment described above.

Then, the normalization unit 112*a* calculates the transformed parameter Y(n) from the parameter X(n) obtained by the parameter calculation unit 101 and the mean $m_i$ and the standard deviation $\sigma_i$ obtained by the normalization coefficient calculation unit 110*a* according to the following equation (20):

$$\hat{y}_i(n)=(x_i(n)-m_i(n))/\sigma_i(n) \tag{20}$$

so that the transformed parameter Y(n) is the difference between the parameter X(n) and a mean vector M(n) of the set $\Omega(n)$ normalized by the variance of the set $\Omega(n)$.

Figure 8:
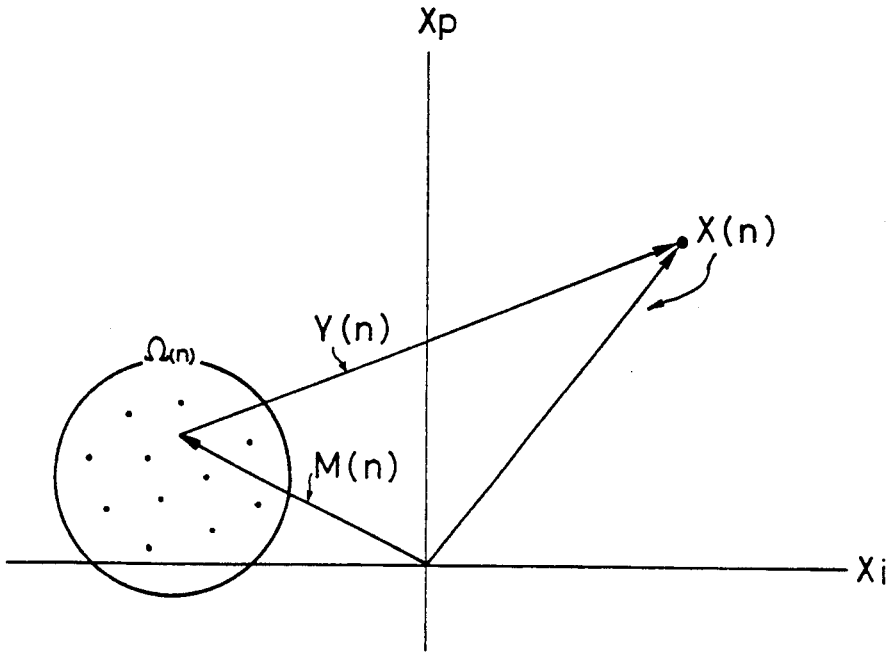
FIG. 8 is a graph showing the relationships of a transformed parameter, a parameter, a mean vector, and a set of parameters of the input frames which are estimated to be noise in the speech detection apparatus of FIG. 6.

Alternatively, the normalization unit 112*a* calculates the transformed parameter Y(n) according to the following equation (21).

$$\hat{y}_i(n)=(x_i(n)-m_i(n)) \tag{21}$$

so that Y(n), X(n), M(n) and $\Omega(n)$ have the relationships depicted in FIG. 8.

Here, $X(n)=(x_1(n), x_2(n), \ldots, x_p(n))$, $M(n)=(m_1(n), m_2(n), \ldots, m_p(n))$, $Y(n)=(y_1(n), y_2(n), \ldots, y_r(n))=(\hat{y}_1(n), \hat{y}_2(n), \ldots, \hat{y}_r(n))$, and $r=p$.

In a case $r<p$, for example, a case where $r=2$, $Y(n)=(y_1(n), y_2(n))=(|(\hat{y}_1(n), \hat{y}_2(n), \ldots, \hat{y}_r(n))|, |(\hat{y}_{k+1}(n), \hat{y}_{k+2}(n), \ldots, \hat{y}_p(n))|)$, where k is a constant.

The buffer control unit 113 inputs the calculated parameters of those input frames judged noise segments by the judging unit 111 into the buffer 109.

Here, until N+S parameters are compiled in the buffer 109, the parameters of only those input frames which have an energy lower than the predetermined threshold $T_0$ are inputted and stored into the buffer 109.

Figure 9:
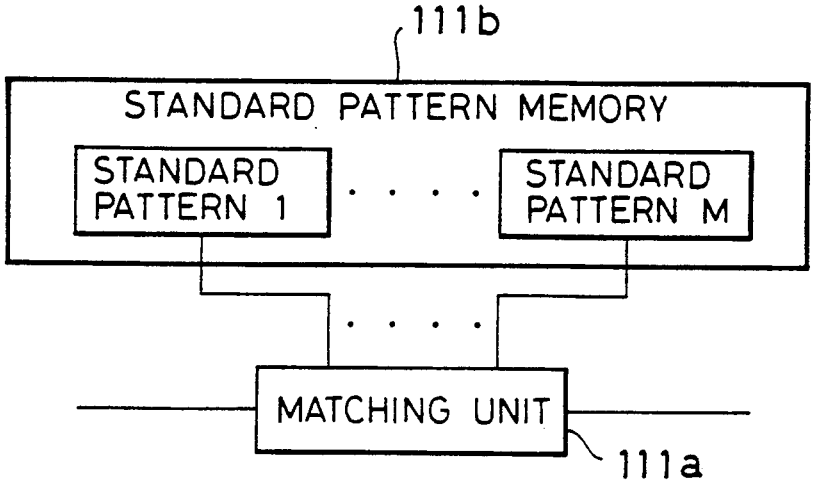
FIG. 9 is a block diagram of a judging unit of the speech detection apparatus of FIG. 6.

The judging unit 111 for judging whether each input frame is a speech segment or noise segment has a detailed configuration shown in FIG. 9 which comprises: a standard pattern memory 111*b* for memorizing M standard patterns for the speech segment and the noise segment; and a matching unit 111*a* for judging whether the input frame is speech or not by comparing the distances between the transformed parameter obtained by the parameter transformation unit 112 with each of the standard patterns.

More specifically, the matching unit 111*a* measures the distance between each standard pattern of the class $\omega_i$ ($i=1, \ldots, M$) and the transformed parameter Y(n) of the n-th input frame according to the following equation (22).

$$D_i(Y(n))=(Y(n)-\mu_i)^t\Sigma_i^{-1}(Y(n)-\mu_i)+ln|\Sigma_i| \tag{22}$$

where a pair formed by $\mu_i$ and $\Sigma_i$ together is one standard pattern of a class $\omega_i$, $\mu_i$ is a mean vector of the transformed parameters $Y\epsilon\omega_i$, and $\Sigma_i$ is a covariance matrix of $Y\epsilon\omega_i$.

Here, a trial set of a class $\omega_i$ contains L transformed parameters defined by:

$$Y_i(j)=(y_{i1}(j), y_{i2}(j), \ldots, y_{im}(j), \ldots, y_{ir}(j)) \tag{23}$$

where j represents the j-th element of the trial set and $1 \leqq j \leqq L$.

$\mu_i$ is an r-dimensional vector defined by:

$$\mu_i = (\mu_{i1}, \mu_{i2}, \ldots, \mu_{im}, \ldots, \mu_{ir}) \tag{24}$$

$$\mu_{im} = (1/L) \sum_{j=1}^{L} y_{im}(j)$$

$\Sigma_i$ is an $r \times r$ matrix defined by:

$$\Sigma_i = [\sigma_{imn}] \tag{25}$$

$$\sigma_{imn} = (1/L) \sum_{j=1}^{L} (y_{im}(j) - \mu_{im})(y_{in}(j) - \mu_{in})$$

The n-th input frame is judged as a speech segment when the class $\omega_i$ represents speech, or as a noise segment otherwise, where the suffix i makes the distance $D_i(Y)$ minimum. Here, some classes represent speech and some classes represent noise.

Figure 10:
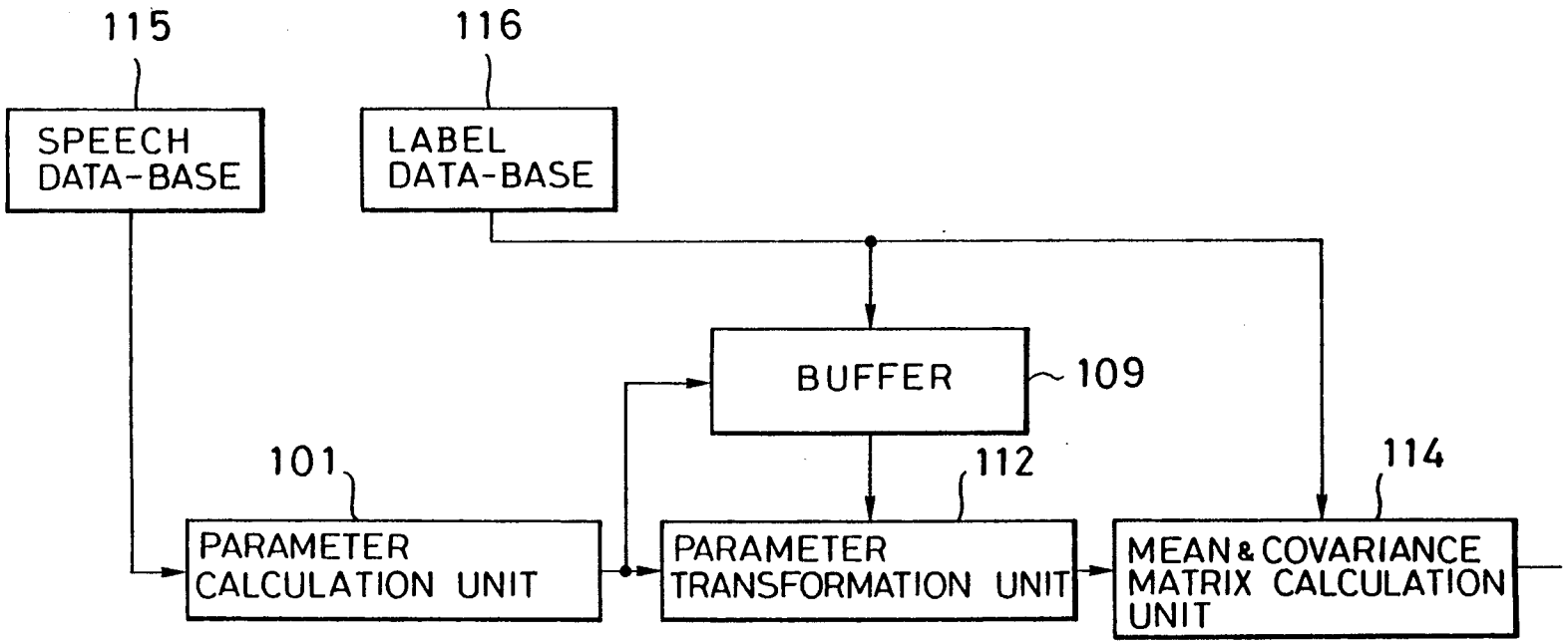
FIG. 10 is a block diagram of a modified configuration for the speech detection apparatus of FIG. 6 for obtaining standard patterns.

The standard patterns are obtained in advance by the apparatus as shown in FIG. 10, where the speech detection apparatus is modified to comprise: buffer 109, parameter calculation unit 101, parameter transformation unit 112, speech data-base 115, label data-base 116 and mean and covariance matrix calculation unit 114.

The voices of some test readers with some kind of noise are recorded on the speech data-base 115. They are labeled in order to indicate to which class each segment belongs. The labels are stored in the label data-base 116.

The parameters of the input frames labeled as noise are stored in the buffer 109. The transformed parameters of the input frames are extrated by the parameter transformation unit 101 using the parameters in the buffer 109 by the same procedure as that described above. Then, using the transformed parameters which belong to the class $\omega_i$, the mean and covariance matrix calculation unit 114 calculates the standard pattern ($\mu_i$, $\Sigma_i$) according to equations (24) and (25) described above.

Figure 11:
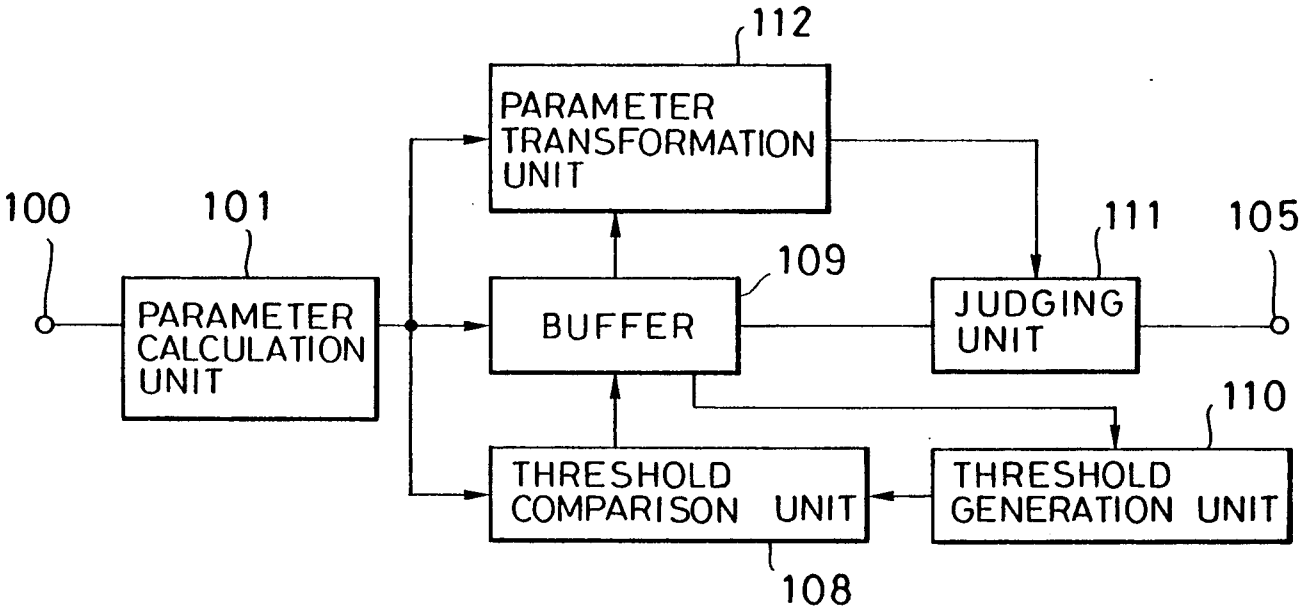
FIG. 11 is a schematic block diagram of the third embodiment of a speech detection apparatus according to the present invention.

FIG. 11 is the third embodiment of a speech detection apparatus according to the present invention.

This speech detection apparatus of FIG. 11 is a hybrid of the first and second embodiments described above and comprises: an input terminal 100 for inputting the audio signals; a parameter calculation unit 101 for acoustically analyzing each input frame to extract a parameter; a parameter transformation unit 112 for transforming the parameter extracted by the parameter calculation unit 101, to obtain a transformed parameter for each input frame; a judging unit 111 for judging whether each input frame is a speech segment or a noise segment according to the transformed parameter obtained by the parameter transformation unit 112; a threshold comparison unit 108 for comparing the calculated parameter of each input frame with a threshold; a buffer 109 for storing the calculated parameters of those input frames which are estimated as noise segments by the threshold comparison unit 108; a threshold generation unit 110 for generating the threshold to be used by the threshold comparison unit 108 according to the parameters stored in the buffer 109; and an output terminal 105 for outputting a signal which indicates the input frame as speech or noise, according to the judgment made by the judging unit 111.

Thus, in this speech detection apparatus, the parameters to be stored in the buffer 109 are determined according to a comparison with the threshold at the threshold comparison unit 108, as in the first embodiment, where the threshold is updated by the threshold generation unit 110 according to the parameters stored in the buffer 109. The judging unit 111 judges whether the input frame is speech or noise by using the transformed parameters obtained by the parameter transformation unit 112, as in second embodiment.

Figure 12:
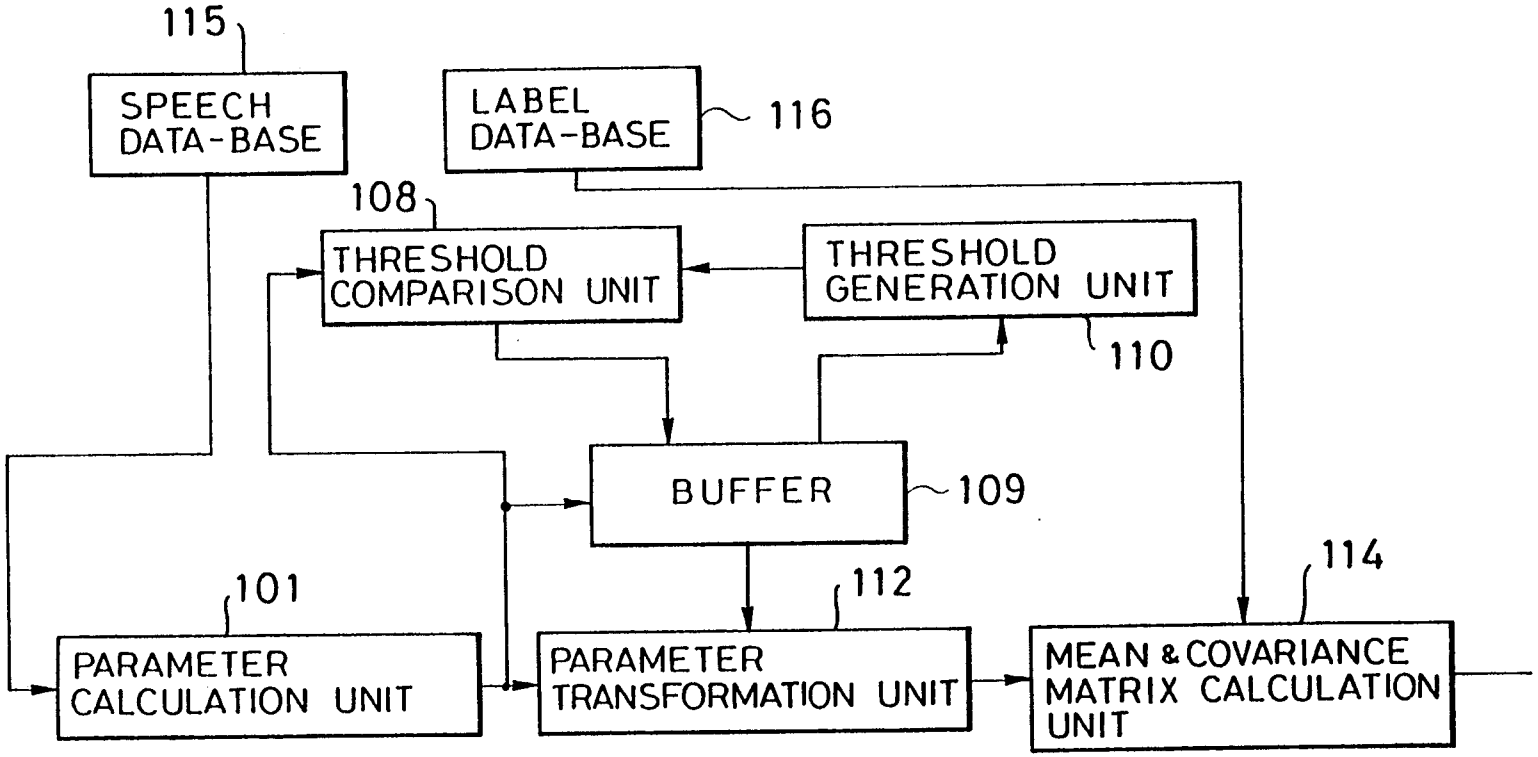
FIG. 12 is a block diagram of a modified configuration for the speech detection apparatus of FIG. 11 for obtaining standard patterns.

Similarly, the standard patterns are obtained in advance by the apparatus as shown in FIG. 12, where the speech detection apparatus is modified to comprise: the parameter calculation unit 101, the threshold comparison unit 108, the buffer 109, the threshold generation unit 110, the parameter transformation unit 112, a speech data-base 115, a label data-base 116, and a mean and covariance matrix calculation unit 114 as in the second embodiment, where the parameters to be stored in the buffer 109 are determined according to the comparison with the threshold at the threshold comparison unit 108 as in the first embodiment, and where the threshold is updated by the threshold generation unit 110 according to the parameters stored in the buffer 109.

Figure 13:
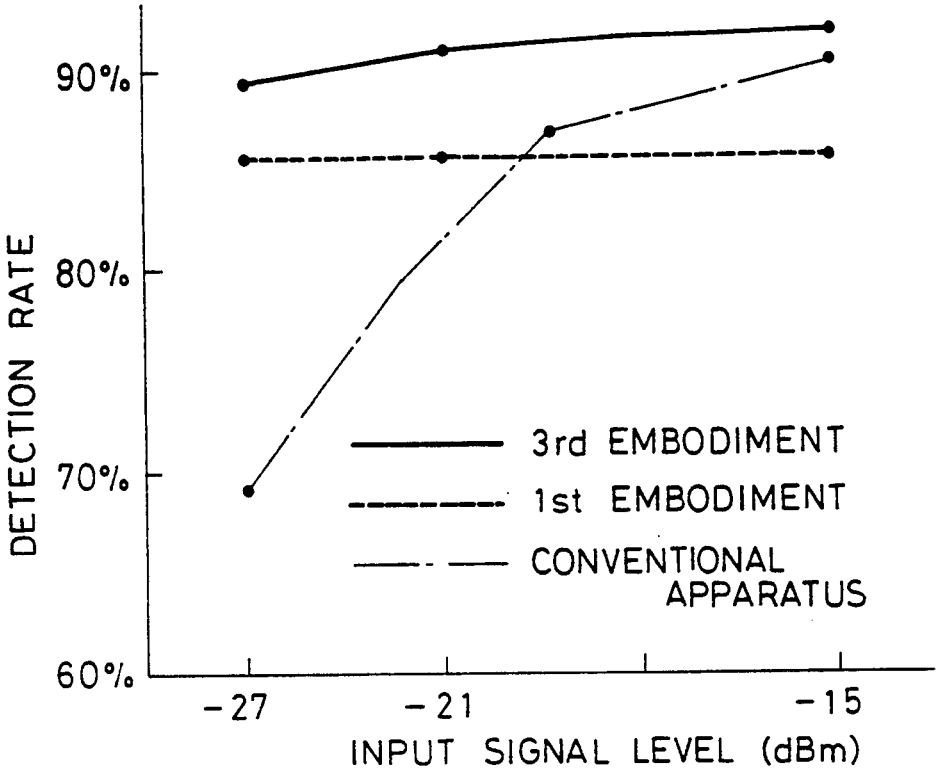
FIG. 13 is a graph of a detection rate versus an input signal level for the speech detection apparatuses of FIG. 3 and FIG. 11, and a conventional speech detection apparatus.
Figure 14:
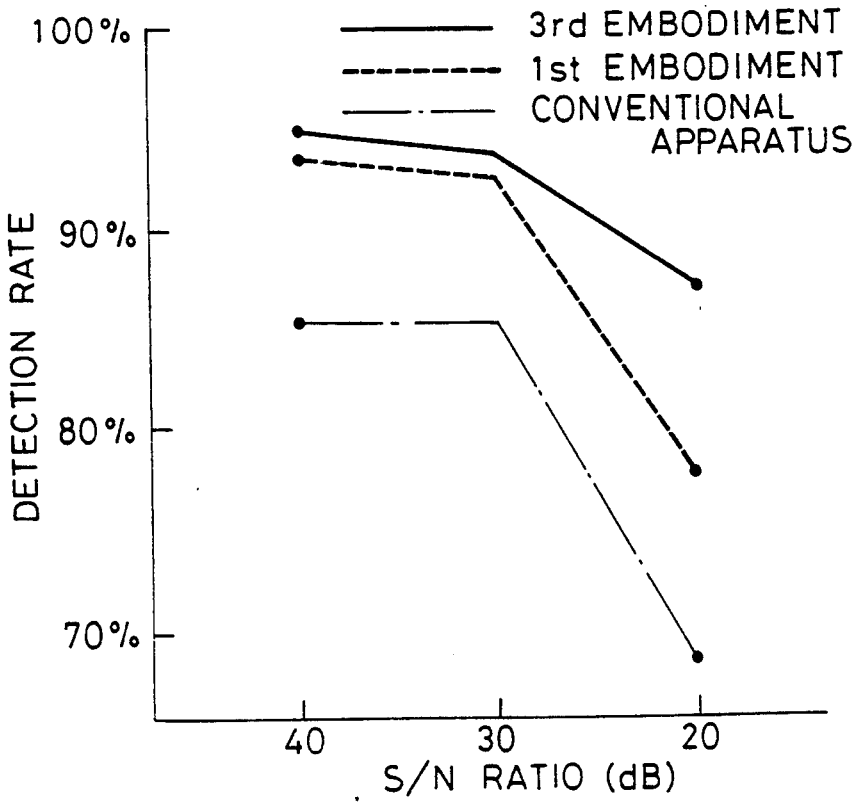
FIG. 14 is a graph of a detection rate versus an S/N ratio for the speech detection apparatuses of FIG. 3 and FIG. 11, and a conventional speech detection apparatus.

As shown in the graphs of FIG. 13 and FIG. 14, plotted in terms of the input audio signal level and S/N ratio, the first embodiment of the speech detection apparatus described above has a superior detection rate compared with conventional speech detection apparatuses, even for the noisy environment having 20 to 40 dB S/N ratio. Moreover, the third embodiment of the speech detection apparatus described above has an even superior detection rate compared with the first embodiment, regardless of the input audio signal level and the S/N ratio.

Figure 15:
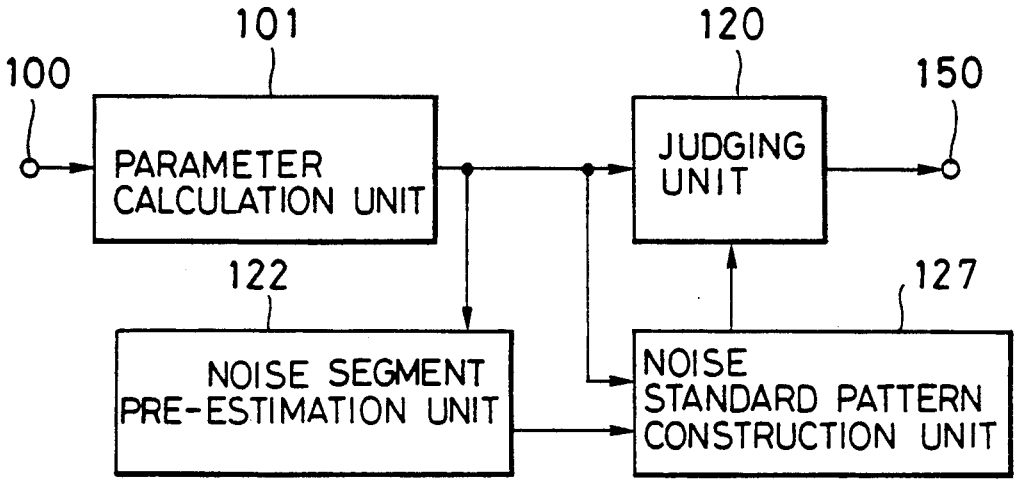
FIG. 15 is a schematic block diagram of the fourth embodiment of a speech detection apparatus according to the present invention.

Referring now to FIG. 15, the fourth embodiment of a speech detection apparatus according to the present invention will be described in detail.

This speech detection apparatus of FIG. 15 comprises: an input terminal 100 for inputting audio signals; a parameter calculation unit 101 for acoustically analyzing each input frame to extract a parameter; a noise segment pre-estimation unit 122 for pre-estimating the noise segments in the input audio signals; a noise standard pattern construction unit 127 for constructing the noise standard patterns by using the parameters of the input frames which are pre-estimated as noise segments by the noise segment pre-estimation unit 122; a judging unit 120 for judging whether the input frame is speech or noise by using the noise standard patterns; and an output terminal 105 for outputting a signal indicating the input frame as speech or noise, according to the judgment made by the judging unit 120.

Figure 16:
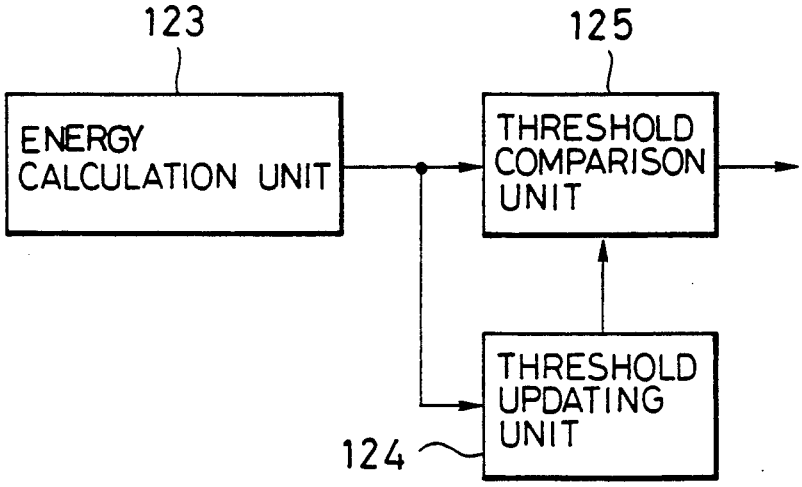
FIG. 16 is a block diagram of a noise segment pre-estimation unit of the speech detection apparatus of FIG. 15.

The noise segment pre-estimation unit 122 has a detailed configuration shown in FIG. 16 which comprises: an energy calculation unit 123 for calculating an average energy P(n) of the n-th input frame; a threshold comparison unit 125 for estimating the input frame as speech or noise by comparing the calculated average energy P(n) of the n-th input frame with a threshold T(n); and a threshold updating unit 124 for updating the threshold T(n) to be used by the threshold comparison unit 125.

In this noise segment estimation unit 122, the energy P(n) of each input frame is calculated by the energy calculation unit 123. Here, n represents a sequential number of the input frame.

Then, the threshold updating unit 124 updates the threshold T(n) to be used by the threshold comparison unit 125 as follows. Namely, when the calculated energy P(n) and the current threshold T(n) satisfy the following relation (26):

$$P(n) < T(n) - P(n) \times (\alpha - 1) \tag{26}$$

where $\alpha$ is a constant, then the threshold T(n) is updated to a new threshold T(n+1) according to the following expression (27):

$$T(n+1) = P(n) \times \alpha \tag{27}$$

On the other hand, when the calculated energy P(n) and the current threshold T(n) satisfy the following relation (28):

$$P(n) \geqq T(n) - P(n) \times (\alpha - 1) \tag{28}$$

then the threshold T(n) is updated to a new threshold T(n+1) according to the following expression (29):

$$T(n+1)=P(n)\times\gamma \tag{29}$$

where $\gamma$ is a constant.

Then, at the threshold comparison unit 125, the input frame is estimated as a speech segment if the energy P(n) is greater than the current threshold T(n). Otherwise the input frame is estimated as a noise segment.

Figure 17:
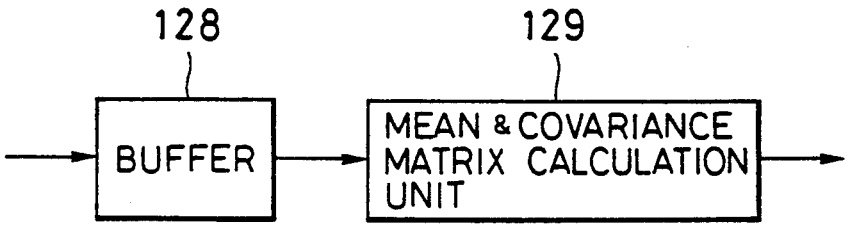
FIG. 17 is a block diagram of a noise standard pattern construction unit of the speech detection apparatus of FIG. 15.

The noise standard pattern construction unit 127 has a detailed configuration as shown in FIG. 17, which comprises a buffer 128 for storing the calculated parameters of those input frames which are estimated as the noise segments by the noise segment pre-estimation unit 122; and a mean and covariance matrix calculation unit 129 for constructing the noise standard patterns to be used by the judging unit 120.

The mean and covariance matrix calculation unit 129 calculates the mean vector $\mu$ and the covariance matrix $\Sigma$ of the parameters in the set $\Omega'(n)$, where $\Omega'(n)$ is a set of the parameters in the buffer 128 and n represents the current input frame number.

The parameter in the set $\Omega'(n)$ is denoted as:

$$X_i(j)=(x_1(j), x_2(j), \ldots, x_m(j), \ldots, x_p(j)) \tag{30}$$

where j represents the sequential number of the input frame shown in FIG. 4. When the class $\omega_k$ represents noise, the noise standard pattern is $\mu_k$ and $\Sigma_k$.

$\mu_k$ is an p-dimensional vector defined by:

$$\mu_k = (\mu_1, \mu_2, \ldots, \mu_m, \ldots, \mu_p) \tag{31}$$

$$\mu_m = (1/N)\sum_{j=1}^{L} x_m(j)$$

$\Sigma_k$ is a p×p matrix defined by:

$$\Sigma_k = [\sigma_{mn}] \tag{32}$$

$$\sigma_{mn} = (1/N)\sum_{j=1}^{L} (x_m(j) - \mu_m)(x_n(j) - \mu_n)$$

where j satisfies the following condition (33):

$$X(j)\epsilon\Omega'(n) \text{ and } j<n-S \tag{33}$$

and takes a larger value in the buffer 109.

Figure 18:
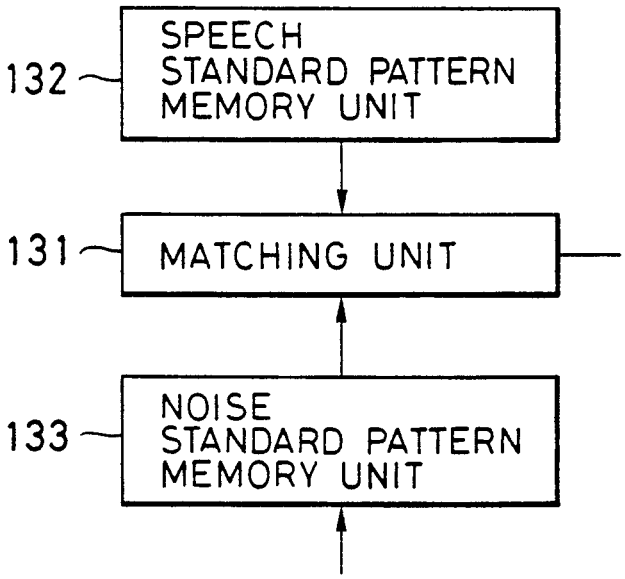
FIG. 18 is a block diagram of a judging unit of the speech detection apparatus of FIG. 15.

The judging unit 120 for judging whether each input frame is a speech segment or a noise segment has the detailed configuration shown in FIG. 18 which comprises: a speech standard pattern memory unit 132 for memorizing speech standard patterns; a noise standard pattern memory unit 133 for memorizing noise standard patterns obtained by the noise standard pattern construction unit 127; and a matching unit 131 for judging whether the input frame is speech or noise by comparing the parameters obtained by the parameter calculation unit 101 with each of the speech and noise standard patterns memorized in the speech and noise standard pattern memory units 132 and 133.

Figure 19:
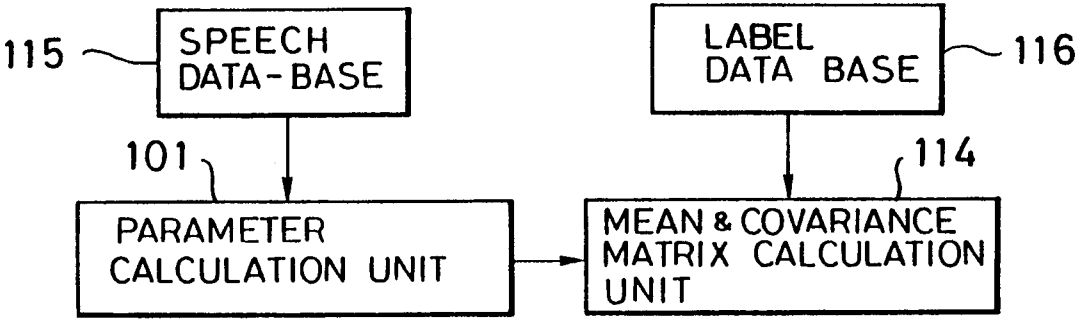
FIG. 19 is a block diagram of a modified configuration for the speech detection apparatus of FIG. 15 for obtaining standard patterns.

The speech standard patterns memorized by the speech standard pattern memory units 132 are obtained as follows. The speech standard patterns are obtained in advance by the apparatus in FIG. 19, where the speech detection apparatus is modified to comprise: the parameter calculation unit 101, a speech data-base 115, a label data-base 116, and a mean and covariance matrix calculation unit 114. The speech data-base 115 and the label data-base 116 are the same as those in the second embodiment.

The mean and covariance matrix calculation unit 114 calculates the standard pattern of class $\omega_i$, except for a class $\omega_k$ which represents noise. Here, a training set of a class $\omega_i$ consists in L parameters defined as:

$$X_i(j)=(x_{i1}(j), x_{i2}(j), \ldots, x_{im}(j), \ldots, x_{ip}(j)) \tag{34}$$

where j represents the j-th element of the training set and $1\leqq j\leqq L$.

$\mu_i$ is a p-dimensional vector defined by:

$$\mu_i = (\mu_{i1}, \mu_{i2}, \ldots, \mu_{im}, \ldots, \mu_{ip}) \tag{35}$$

$$\mu_{im} = (1/L)\sum_{j=1}^{L} x_{im}(j)$$

$\Sigma_i$ is a p×p matrix defined by:

$$\Sigma_i = [\sigma_{imn}] \tag{36}$$

$$\sigma_{imn} = (1/L)\sum_{j=1}^{L} (x_{im}(j) - \mu_{im})(x_{in}(j) - \mu_{in})$$

Figure 20:
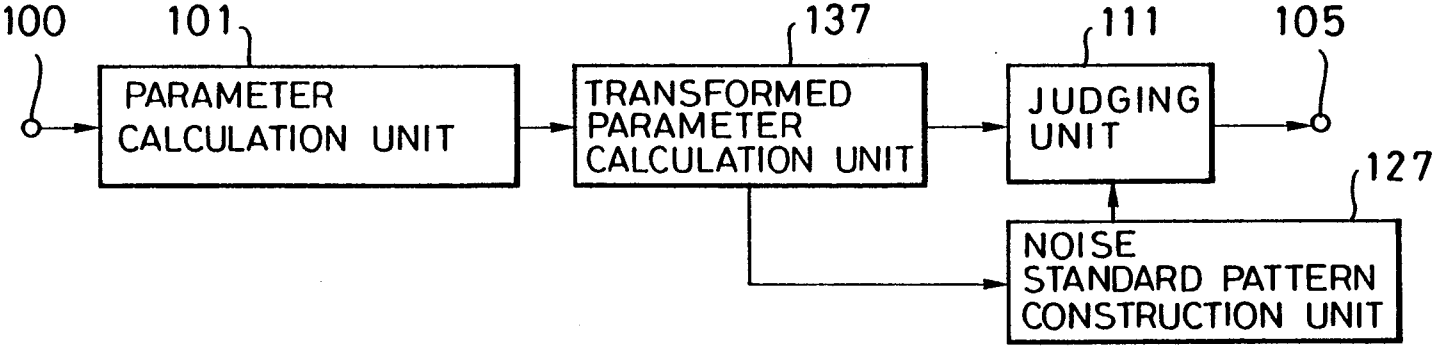
FIG. 20 is a schematic block diagram of the fifth embodiment of a speech detection apparatus according to the present invention.

Referring now to FIG. 20, the fifth embodiment of a speech detection apparatus according to the present invention will be described in detail.

The speech detection apparatus of FIG. 20 is a hybrid of the third and fourth embodiments, and comprises: an input terminal 100 for inputting audio signals; a parameter calculation unit 101 for acoustically analyzing each input frame to extract a parameter; a transformed parameter calculation unit 137 for calculating the transformed parameter by transforming the parameter extracted by the parameter calculation unit 101; a noise standard pattern construction unit 127 for constructing noise standard patterns according to the transformed parameter calculated by the transformed parameter calculation unit 137; a judging unit 111 for judging whether each input frame is a speech segment or a noise segment, according to the transformed parameter obtained by the transformed parameter calculation unit 137 and the noise standard patterns constructed by the noise standard pattern construction unit 127; and an output terminal 105 for outputting a signal which indicates the input frame as speech or noise according to the judgment made by the judging unit 111.

Figure 21:
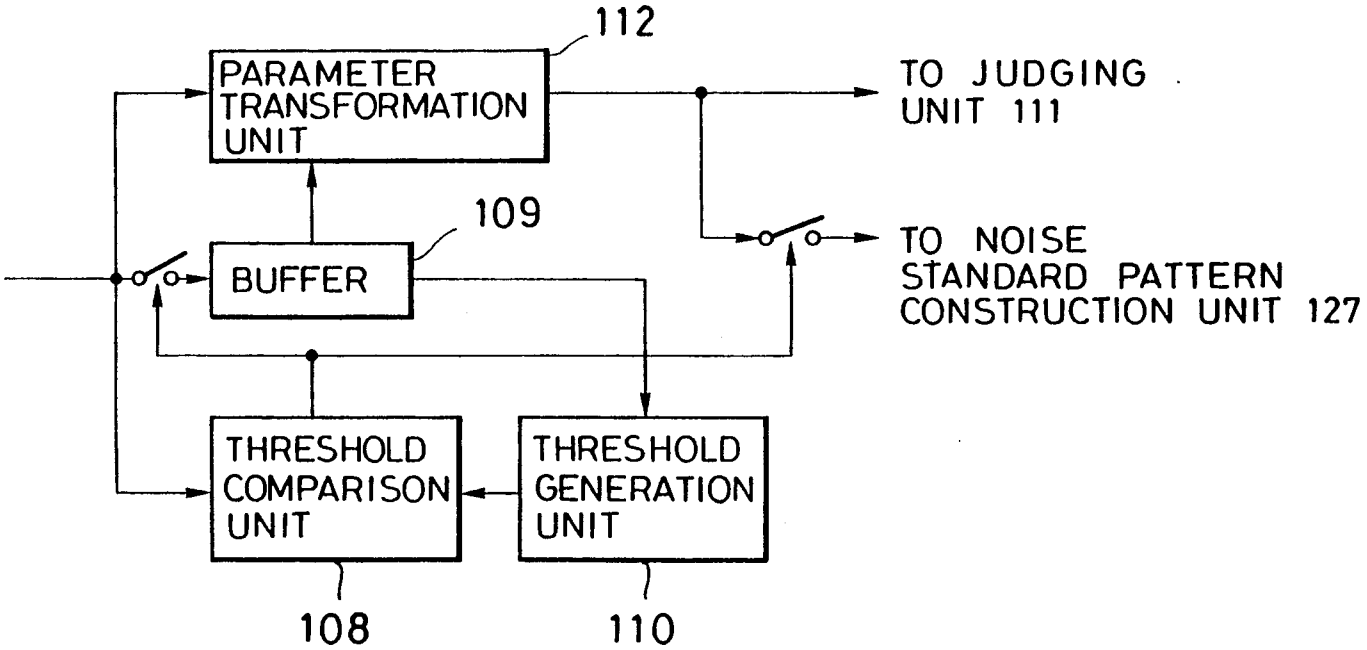
FIG. 21 is a block diagram of a transformed parameter calculation unit of the speech detection apparatus of FIG. 20.

The transformed parameter calculation unit 137 has a detailed configuration as shown in FIG. 21 which comprises parameter transformation unit 112 for transforming the parameter extracted by the parameter calculation unit 101 to obtain the transformed parameter; a threshold comparison unit 108 for comparing the calculated parameter of each input frame with a threshold; a buffer 109 for storing the calculated parameters of those input frames which are determined as the noise segments by the threshold comparison unit 108; and a threshold generation unit 110 for generating the threshold to be used by the threshold comparison unit 108 according to the parameters stored in the buffer 109.

Thus, in this speech detection apparatus, the parameters to be stored in the buffer 109 are determined according to a comparison with the threshold at the threshold comparison unit 108 as in the third embodiment, where the threshold is updated by the threshold generation unit 110 according to the parameters stored in the buffer 109. On the other hand, the judgment of each input frame as a speech segment or a noise segment is made by the judging unit 111 by using the transformed parameters obtained by the transformed parameter calculation unit 137 as in the third embodiment, as well as by using the noise standard patterns constructed by the noise standard pattern construction unit 127 as in the fourth embodiment.

It is to be noted that many modifications and variations of the above embodiments may be made without departing from the novel and advantageous features of the present invention. Accordingly, all such modifications and variations are intended to be included within the scope of the appended claims.

What is claimed is:

1. A speech detection apparatus, comprising:

means for calculating a parameter for each one of input frames of an input speech;

means for judging said each one of the input frames as a speech segment or a noise segment;

buffer means for storing the parameters of the input frame which are judged noise segments by the judging means; and means for transforming the parameter calculated by the calculating means into a transformed parameter in which a difference between speech and noise is emphasized by using the parameters stored in the buffer means, and supplying the transformed parameter to the judging means such that the judging means judges by searching a predetermined standard pattern of a class to which the transformed parameter belongs among a plurality of standard patterns for the speech segment and the noise segment.

2. The speech detection apparatus of claim 1, wherein the transforming means transforms the parameter into the transformed parameter which is a difference between a the parameter and a mean vector of a set of the parameters stored in the buffer means.

3. The speech detection apparatus of claim 1, wherein the transforming means transforms the parameter into the transformed parameter which is a normalized difference between the parameter and a mean vector of a set of the parameters stored in the buffer means, where the transformed parameter is normalized by a standard deviation of elements of a set of the parameters stored in the buffer means.

4. The speech detection apparatus of claim 1, wherein the judging means judges said each one of the input frames as a speech segment or a noise segment by searching a predetermined standard pattern which has a minimum distance from the transformed parameter of said each one of the input frames.

5. The speech detection apparatus of claim 4, wherein the distance between the transformed parameter of said each one of the input frames and the standard pattern of a class $\omega_i$ is defined as:

$$D_i(Y)=(Y-\mu_i)^t\Sigma_i^{-1}(Y-\mu_i)+\ln|\Sigma_i|$$

where $D_i(Y)$ is the distance, Y is the transformed parameter, $\mu_i$ is a mean vector of a set of the transformed parameters of the class $\omega_i$, $\Sigma_i$ is a covariance matrix of the set of the transformed parameters of a class $\omega_i$, i is an integer, and $(Y-\mu_i)^t$ denotes a transpose of $(Y-\mu_i)$.

6. The speech detection apparatus of claim 5, wherein a trial set of a class $\omega_i$ contains L transformed parameters defined by:

$$Y_i(j)=(y_{i1}(j),y_{i2}(j),\ldots,y_{im}(j),\ldots,y_{ir}(j))$$

where j represents the j-th element of the trial set and $1\leqq j\leqq L$, the mean vector $\mu_i$ is defined as an r-dimensional vector given by:

$$\mu_i=(\mu_{i1},\mu_{i2},\ldots,\mu_{im},\ldots,\mu_{ir})$$

$$\mu_{im}=(1/L)\sum_{j=1}^{L}y_{im}(j)$$

and the covariance matrix $\Sigma_i$ is defined as an $r\times r$ matrix given by:

$$\Sigma_i=[\sigma_{imn}]$$

$$\sigma_{imn}=(1/L)\sum_{j=1}^{L}(y_{im}(j)-\mu_{im})(y_{in}(j)-\mu_{in})$$

and the standard pattern is given by a pair $(\mu_i, \Sigma_i)$ formed by the mean vector $\mu_i$ and the covariance matrix $\Sigma_i$, where m and n are integers.

7. A speech detection apparatus, comprising:

means for calculating a parameter of each one of input frames of an input speech;

means for comparing the parameter calculated by the calculating means with a threshold in order to pre-estimate noise segments in input audio signals;

buffer means for storing the parameters of the input frames which are pre-estimated as the noise segments by the comparing means;

means for updating the threshold according to the parameters stored in the buffer means;

means for judging said each one of the input frames as a speech segment or a noise segment; and means for transforming the parameter calculated by the calculating means into a transformed parameter in which a difference between speech and noise is emphasized by using the parameters stored in the buffer means, and supplying the transformed parameter to the judging means such that the judging means judges by searching a predetermined standard pattern of a class to which the transformed parameter belongs among a plurality of standard patterns for the speech segment and the noise segment.

8. A speech detection apparatus, comprising:

means for calculating a parameter of each one of input frames of an input speech;

means for pre-estimating noise segments in input audio signals of the input speech;

means for constructing a plurality of noise standard patterns from the parameters of the noise segments pre-estimated by the pre-estimating means; and means for judging said each one of the input frames as a speech segment or a noise segment by comparing the parameter of the input frame with said plurality of the noise standard patterns constructed by the constructing means and a plurality of predetermined speech standard patterns.

9. The speech detection apparatus of claim 8, wherein the pre-estimating means includes:

means for obtaining the energy of said each one of the input frames;

means for comparing the energy obtained by the obtaining means with a threshold in order to estimate said each one of the input frames as a speech segment or a noise segment; and means for updating the threshold according to the energy obtained by the obtaining means.

10. The speech detection apparatus of claim 9, wherein the updating means updates the threshold such that when the energy P(n) of an n-th input frame and a current threshold value T(n) for the threshold satisfy the relation:

$$P(n) < T(n) - P(n) \times (\alpha - 1)$$

where $\alpha$ is a constant and n is an integer, then the threshold value T(n) is updated to a new threshold value T(n+1) given by:

$$T(n+1) = P(n) \times \alpha$$

whereas when the energy P(n) and the current threshold value T(n) satisfy the relation:

$$P(n) \geqq T(n) - P(n) \times (\alpha - 1)$$

then the threshold value T(n) is updated to a new threshold value T(n+1) given by:

$$T(n+1) = P(n) \times \gamma$$

where $\gamma$ is a constant.

11. The speech detection apparatus of claim 8, wherein the constructing means constructs the noise standard patterns by calculating a mean vector and a covariance matrix for a set of the parameters of the input frames which are pre-estimated as the noise segments by the pre-estimating means.

12. The speech detection apparatus of claim 8, wherein the judging means judges said each one of the input frames by searching one of the standard patterns which has a minimum distance from the parameter of said each one of the input frames.

13. The speech detection apparatus of claim 12, wherein the distance between the parameter of said each one of the input frames and the standard patterns of a class $\omega_i$ is defined as:

$$D_i(X) = (X - \mu_i)^t \Sigma_i^{-1} (X - \mu_i) + \ln|\Sigma_i|$$

where $D_i(X)$ is the distance, X is the parameter of the input frame, $\mu_i$ is a mean vector of a set of the parameters of the class $\omega_i$, $\Sigma_i$ is a covariance matrix of the set of the parameters of the class $\omega_i$, i is an integer, and $(X-\mu_i)^t$ denotes a transpose of $(X-\mu_i)$.

14. The speech detection apparatus of claim 13, wherein a trial set of a class $\omega_i$ contains L transformed parameters defined by:

$$X_i(j) = (x_{i1}(j), x_{i2}(j), \ldots, x_{im}(j), \ldots, x_{ip}(j))$$

where j represents the j-th element of the trial set and $1 \leqq j \leqq L$, the mean vector $\mu_i$ is defined as an p-dimensional vector given by:

$$\mu_i = (\mu_{i1}, \mu_{i2}, \ldots, \mu_{im}, \ldots, \mu_{ip})$$

$$\mu_{im} = (1/L) \sum_{j=1}^{L} X_{im}(j)$$

and the covariance matrix $\Sigma_i$ is defined as a $p \times p$ matrix given by:

$$\Sigma_i = [\sigma_{imn}]$$

$$\sigma_{imn} = (1/L) \sum_{j=1}^{L} (x_{im}(j) - \mu_{im})(x_{in}(j) - \mu_{in})$$

and the standard pattern is given by a pair $(\mu_i, \Sigma_i)$ formed by the mean vector $\mu_i$ and the covariance matrix $\Sigma_i$, where m and n are integers.

15. A speech detection apparatus, comprising:

means for calculating a parameter of each one of input frames of an input speech;

means for transforming the parameter calculated by the calculating means into a transformed parameter in which a difference between speech and noise is emphasized;

means for constructing a plurality of noise standard patterns from the transformed parameters; and means for judging said each one of the input frames as a speech segment or a noise segment by comparing the transformed parameter obtained by the transforming means with said plurality of noise standard patterns constructed by the constructing means.

16. The speech detection apparatus of claim 15, wherein the transforming means includes:

means for comparing the parameter calculated by the calculating means with a threshold in order to estimate said each one of the input frames as a speech segment or a noise segment, and to control the constructing means such that the constructing means constructs the noise standard patterns from the transformed parameters of the input frames estimated as the noise segments;

buffer means for storing the parameters of the input frames which are estimated as the noise segments by the comparing means;

means for updating the threshold according to the parameters stored in the buffer means; and transformation means for obtaining the transformed parameter from the parameter by using the parameters stored in the buffer means.

* * * * *